US010194488B2

(12) United States Patent
Schlipf

(10) Patent No.: US 10,194,488 B2
(45) Date of Patent: Jan. 29, 2019

(54) ELECTRIC HEATER WITH CONNECTION WIRE

(71) Applicant: Türk & Hillinger GmbH, Tuttlingen (DE)

(72) Inventor: Andreas Schlipf, Tuttlingen (DE)

(73) Assignee: Türk & Hillinger GmbH, Tuttlingen (DE)

( * ) Notice: Subject to any disclaimer, the term of this patent is extended or adjusted under 35 U.S.C. 154(b) by 450 days.

(21) Appl. No.: 14/932,097

(22) Filed: Nov. 4, 2015

(65) Prior Publication Data

US 2016/0057813 A1 Feb. 25, 2016

Related U.S. Application Data

(62) Division of application No. 13/603,776, filed on Sep. 5, 2012, now abandoned.

(30) Foreign Application Priority Data

Sep. 6, 2011 (DE) ..... 20 2011 105 348 U

(51) Int. Cl.

| | |
|---|---|
| ***H05B 3/06*** | (2006.01) |
| ***H05B 3/44*** | (2006.01) |
| ***H05B 3/48*** | (2006.01) |
| ***H05B 6/06*** | (2006.01) |

(52) U.S. Cl.

CPC ..... *H05B 3/06* (2013.01); *H05B 3/44* (2013.01); *H05B 3/48* (2013.01); *H05B 6/06* (2013.01)

(58) Field of Classification Search

CPC ... H05B 3/48; H05B 3/44; H05B 3/06; H05B 6/06

USPC ..... 219/541, 546

See application file for complete search history.

(56) References Cited

U.S. PATENT DOCUMENTS

| | | | | | |
|---|---|---|---|---|---|
| 3,225,321 | A * | 12/1965 | Walter | H05B 3/00 | 174/76 |
| 3,476,916 | A * | 11/1969 | La Van | H05B 3/48 | 174/77 R |
| 4,207,552 | A * | 6/1980 | Brent | H01C 1/14 | 174/77 R |
| 4,388,523 | A * | 6/1983 | Keep, Jr. | H05B 3/06 | 174/77 R |
| 6,071,163 | A * | 6/2000 | Chang | H01T 13/39 | 313/118 |
| 2006/0227056 | A1* | 10/2006 | Brittingham | B64D 15/12 | 343/704 |

* cited by examiner

*Primary Examiner* — Dana Ross

*Assistant Examiner* — Kuangyue Chen

(74) *Attorney, Agent, or Firm* — McGlew and Tuttle, P.C.

(57) ABSTRACT

An electric heater (100, 200, 300, 1600, 1700, 2200) has an outer jacket (101, 201, 301, 1601, 1701, 2201) and an electric heating element (102, 202, 302, 2202), which can be supplied with an electric current by at least one connecting wire (106, 107, 206, 207, 306, 307, 406, 506, 606, 706, 806, 906, 1006, 1106, 1206, 1306, 1406, 1506, 1606, 1607, 1608, 1706, 1806, 2206, 2207), arranged at least in some sections within the outer jacket (101, 201, 301, 1601, 1701, 2201). The connecting wire (106, 107, 206, 207, 306, 307, 406, 506, 606, 706, 806, 906, 1006, 1106, 1206, 1306, 1406, 1506, 1606, 1607, 1608, 1706, 1806, 2206, 2207) has a cavity, in which a section (104, 105, 204, 205, 2204, 2205) of the electric heating element (102, 202, 2202) or an electric feed line (330, 331) to the electric heating element (302) is accommodated.

18 Claims, 7 Drawing Sheets

A-A 406
430

406
A
A
402
430
B-B 506
502

506
B
B
502
504
C-C 650
606
602

606
650
C
C
602
D-D 706
750
702

706
702
704
706
750
D
D
E-E

E
E
802
806

802
806

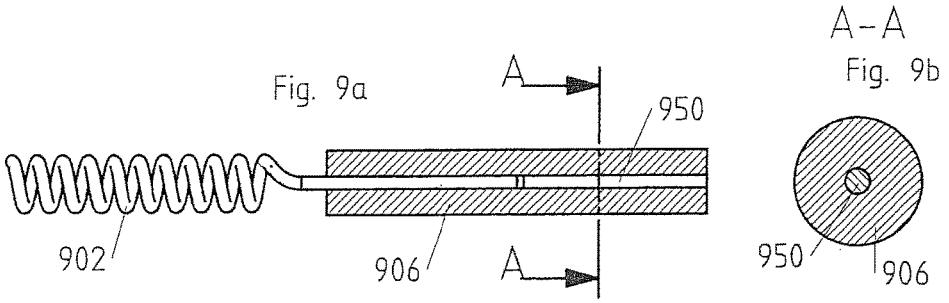
Fig. 9a
A
950
902
906
A
A-A
Fig. 9b
950
906
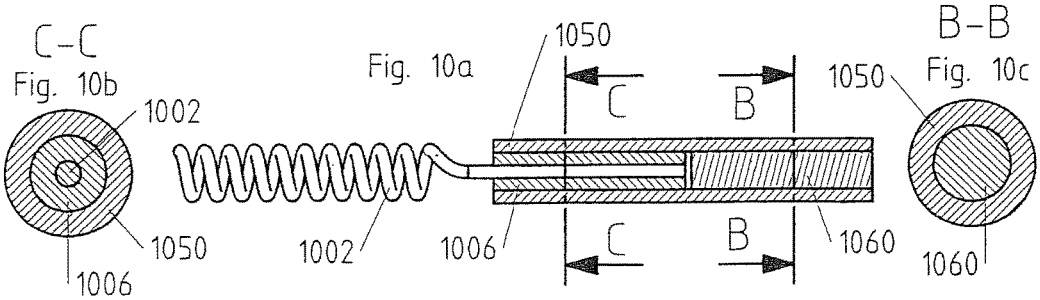
C-C
Fig. 10b
1002
1050
1006
Fig. 10a
1050
C
B
1002
1006
C
B
1060
B-B
Fig. 10c
1050
1060
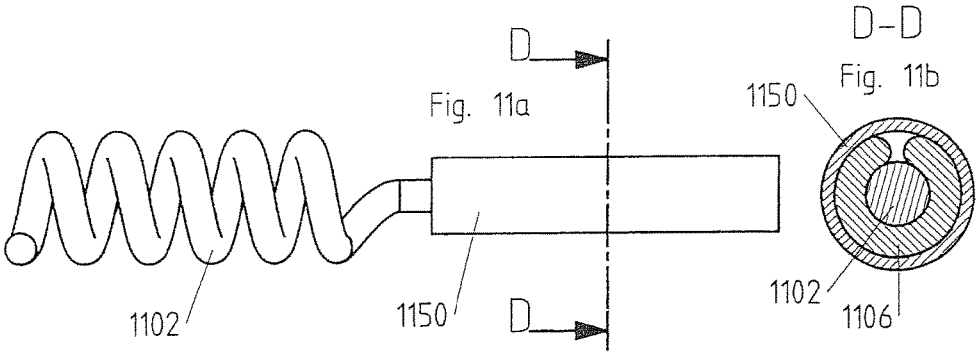
D
Fig. 11a
1102
1150
D
D-D
Fig. 11b
1150
1102
1106
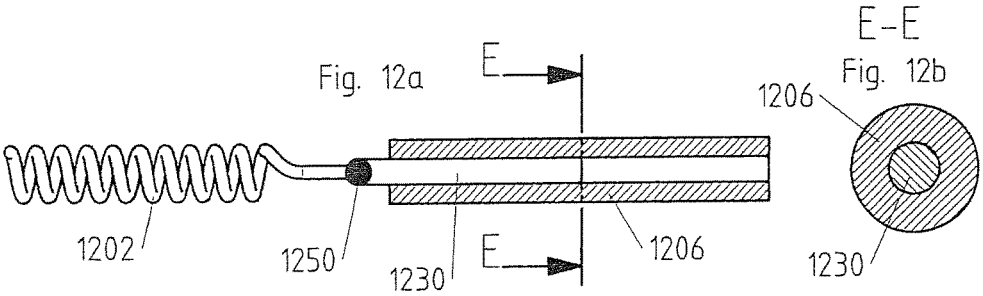
Fig. 12a
E
1202
1250
1230
E
1206
E-E
Fig. 12b
1206
1230

G-G

H-H

J-J

K-K

ELECTRIC HEATER WITH CONNECTION WIRE

CROSS REFERENCE TO RELATED APPLICATIONS

This application is a divisional under 37 CFR 1.53(b) of pending prior application Ser. No. 13/603,776 filed Sep. 5, 2012 and claims the benefit under 35 U.S.C. § 119 of German Utility Model 20 2011 105 348.6 filed Sep. 6, 2011, the entire contents of each application are incorporated herein by reference.

FIELD OF THE INVENTION

The invention relates to electric heaters. Such electric heaters are widely used means for heating different objects and materials.

BACKGROUND OF THE INVENTION

Up to now, the electric contacting of the heating element of such an electric heater, which is usually designed as a resistance wire and is sometimes called a heating wire or heating conductor as well, is usually implemented in the following ways:

First, an attempt can be made to work with crimp connectors. This is problematic—especially when a connection shall be made in the interior of the jacket of an electric heater—on the one hand, with manual production with regard to the desired process safety, since three parts have to be positioned together exactly at the same time, and, on the other hand, with regard to achieving a compact design, since a connection made according to the crimping instructions usually leads to applying the crimped sleeve in the direction, in which it is not pressed together.

On the one hand, it is known to provide a ceramic, especially porous, component with at least one hole, in which an end section of the electric heating element is crimped with a connecting wire in an overlapping manner. However, this solution almost always means that the structural space needed is enlarged, because besides the hole, which electric heating element and connecting wire must accommodate, a wall thickness must be provided that withstands the mechanical stresses occurring and guarantees the necessary electric insulation.

On the other hand, it is known that a connecting wire is butt-jointed or firmly welded at the heating element in an overlapping manner. However, this is especially not a satisfactory solution if one has to work with high currents and/or small resistances and/or relatively low voltages for operating the electric heater, such that transfer or contact resistances can be made highly noticeable with regard to the process safety achieved. On the one hand, differences in weight ratios of connecting wires and electric heating element have a negative effect on the quality of the resulting welded connection.

This approach also requires an exact positioning of the welding spot, since, especially in plasma or microplasma welding, the slightest deviations, especially a cross-sectional reduction of the weld, may have a negative effect on the electric contacting, and a slight slipping or unsteadiness of the parts to be connected in relation to one another during curing of the melt may already lead to an inhomogeneous melt, which likewise means contact problems. Such an unsteadiness may also force a subsequent mechanical alignment and/or calibration of the welded connection for achieving the marginal conditions regarding the space, which may mean further contact problems.

Finally, an application of material to the weld joint cannot always be avoided even when providing welded connections, which increases the space needed for installation.

SUMMARY OF THE INVENTION

Therefore, an object of the present invention is to provide a possibility for the cost-effective, safe and compact contacting of the heating wire of an electric heater with low contact resistance, which can be used, as needed, even on the smallest installation space and even in special applications with low resistances, e.g., up to below 0.5 Ohm and/or high currents, e.g., up to above 8 Ampere.

According to the invention, an electric heater is provided comprising an outer jacket, an electric heating element and a connecting wire arranged at least in some sections within the outer jacket. The electric heating element is supplied with electric current by the connecting wire. The connecting wire has a cavity, in which a section of the electric heating element or an electric feed line to the electric heating element is accommodated.

The electric heater according to the present invention has an outer jacket, e.g., in the form of a metal tube, and an electric heating element, e.g., in the form of a resistance wire that can be supplied with current via at least one connecting wire, arranged at least in some sections within the outer jacket.

It is essential to the present invention that the connecting wire has a cavity, in which a section of the electric heating element or an electric feed line to the electric heating element is accommodated.

By arranging a section of the electric heating element in this cavity (i.e., the at least partial filling of the cavity with the electric heating element or the electric feed line to the electric heating element), a defined and readily reproducible positioning with a large contact surface is made possible, which leads to defined, readily reproducible and low contact resistances. Thus, it is then also possible to make possible a more reliable monitoring of functions by applying a low voltage, as is carried out, e.g., in the automotive field partly by means of the electronic control unit of the motor vehicle, which may simulate a failure of an electric heater when too high contact resistances are present, which would still operate flawlessly when applying the actual operating voltage.

In addition, the arrangement according to the present invention in many cases guarantees that the space needed for the arrangement remains extremely low.

It is pointed out that when selecting an electrically well conductive material for the connecting wire in the section of the connecting wire filled with the electric heating element or with the feed line to the electric heating element, the largest part, especially over 50%, preferably over 75%, and most preferably over 90% of the flowing current thus flows through the connecting wire.

At the same time, an improvement is also achieved regarding the connection of the electric heater to the external connection lines, via which the current is fed. In heated areas of the electric heater, the electric heating element shall have a high electric resistance, which frequently means a small cross section. However, in the connection lines, an effort is made to keep the resistance low, considering the high flowing currents, such that they shall have a large cross section.

The safe and reproducible connection of a conductor having a large cross section and a conductor having a small cross section by means of welding, especially in the plasma or microplasma welding process, but also in other welding processes, such as laser or resistance welding, and especially in a butt joint, is, however, problematic, as long as it takes place on a small surface, because different quantities of energy are needed for melting the respective ends of parts to be connected. By using a connecting wire having a cavity in which a section of the electric heating element is accommodated, the contact surface between the electric heating element and the connecting wire is enlarged and a connection between a connecting wire and a usually external connection line, which have lower cross-sectional differences, is made possible.

In addition, it shall be stressed that by means of the contacting according to the present invention, a simple and process-safe connection is created, which can be produced cost-effectively and which makes it possible to keep the number of contacts within the jacket to be provided low (and even to reduce same to a single, preferably large-surface contact point).

This advantage is especially maximized by the connecting wire being led through the jacket, and thus, the number of the contact points within the jacket, which can practically hardly be repaired because of their poor accessibility, can be reduced on the transfer between the resistance wire and connecting wire.

Still another advantage of the present invention is that the large-surface electric contact area thus provided leads to a very high vibration resistance, which is especially important in the automotive field of application or in point heating systems.

It is pointed out, as a precaution, that the terms "connecting wire" and "connection line" stand for different components in this specification. The connecting wire is a component of the electric heater and is connected to same. The connection line is an external supply line, to which the electric heater is connected.

This basic principle of the present invention can be embodied with especially little effort when the connecting wire has the form of a tube or the form of a tube having a slot traversing the tube in its direction of extension, as results, for example, when bending together a thin metal plate, because no further processing step is then necessary to create a cavity in a connecting wire. In this case, one simply has to introduce the electric heating element or the feed line to same into the tube. A defined depth of introduction can be guaranteed by providing a stop. The tube may especially be a seamless drawn or welded tube.

An especially low temperature development in an unheated area of the electric heater can especially be guaranteed by the cross-sectional surface of the tube wall (i.e., the part of the cross section of the tube that is not allotted to the interior of the tube) being greater than the cross section of the electric heating element.

To achieve an especially slender design, it is practical when the wall thickness of the tube is smaller than the diameter of the electric heating element.

The tube cross section may also be selected so that it essentially corresponds to the diameter of coils of the electric heating element, which likewise makes compact designs possible.

It is especially advantageous when the connecting wire, designed as a tube, has a section that is not filled by the section of the electric heating element or of the electric feed line to the electric heating element and when this section is especially at least partly crimped, such that the outer diameter of the tubular connecting wire is reduced. Consequently, an improved insulation of this section of the connecting wire to the outer jacket of the electric heater, which can be especially important when the electric heater shall be deformed, e.g., crimped in this area, is achieved.

The tube section not filled by the electric heating element can be arranged especially partly within the jacket and partly outside the jacket. If the electric heater is then crimped along the length of its jacket, the unfilled tube section, which is arranged outside the jacket, additionally has a cavity that can then be used advantageously for simple and safe connection to the conductor of a connection line.

The tube section not filled by the section of the electric heating element or the electric feed line to the electric heating element may, however, also be filled with insulating material.

It is especially favorable for avoiding an enlarged outer contour in one direction and for achieving a homogeneous electric contact when the connecting wire is isotropically deformed by crimping in directions at right angles to its direction of extension.

An isotropic deformation means that an especially sharp deformation was not brought about in any direction (as is the case, e.g., when crimping according to most crimping instructions), and that the deformation did not occur in different directions with different signs, which would be the case when a cross-sectional reduction in one direction would be accompanied by a cross-sectional increase in another direction. It is especially present if a uniform deformation in all these directions occurred. If necessary, an additional crimping not according to instructions could also be used in order to further improve the contact.

Especially good electric contact and thus especially low contact resistances can be brought about by an electric heater according to the present invention when the connecting wire is crimped with the electric heating element or electric feed line to the electric heating element. This step can be carried out in an especially economic manner when the cavity is arranged in a compressed section of the electric heater, because the crimping can then be carried out together with a crimping step which is necessary anyway in most cases in the production of the electric heater.

In another especially advantageous embodiment of the present invention provisions are made for the connecting wire to extend further in the interior enclosed by the jacket than is necessary for creating an electric connection (to which, e.g., crimped sleeves are limited). This leads to the electric heating element in this area of the electric heater comprising the actual heating wire and the wall of the connecting wire defining the cavity, especially the tube wall of a tubular connecting wire, which leads to a larger cross section of the electric heating element, which in turn reduces the resistance in this section and thus reduces the development of heat there.

This is especially desirable since an unheated area (which is defined as an area of the electric heater, in which the heat output shall be minimal during operation of the electric heater) is usually provided at at least one end of the area of the electric heater enclosed by the jacket. Then, the connecting wire and/or its cavity shall advantageously extend over the entire unheated area. The effect of this arrangement can be maximized when the connecting wire consists of a material, which has a higher electric conductivity than the electric conductivity of the heating wire.

The connecting wire may especially be made of copper or another readily conductive, but poorly weldable material, which is possible only with a high technical effort in the welded connections known from the state of the art.

It should be noted that providing an electric heater, which has an outer jacket and an electric heating element arranged within the outer jacket, as well as an unheated area, in which the cross section of the electric heating element is increased at least in a section of the unheated area of the cross section of the electric heating element, especially by pushing a sleeve or slotted sleeve, which especially consists of a material that has a higher electric conductivity than the electric conductivity of the heating wire, onto a heating wire, is considered to be a second, independent invention, with which the object of reducing the unwanted heating effect on "unheated" sections of an electric heater, i.e., especially on the sections, on which the length of the electric heating element arranged therein only corresponds to the length of the section and thus coming closer to the ideal of an electric heater with unheated area is accomplished. This independent idea of the present invention may be combined with the features which are claimed and/or disclosed in connection with the first invention and its technical effects, and it is especially also subject to all exemplary embodiments discussed below.

In connection with the first invention reference is again made to another advantageous variant of the invention, in which the connecting wire is surrounded by a sleeve or a slotted sleeve at least in some sections. This measure makes it possible to modify the external properties of the connecting wire in a desired manner.

Thus, for example, the production of a welded connection to a connection line provided outside the electric heater can be made easier, or such a connection line can be brought into safe electric contact with the connecting wire by clamping with the sleeve, and/or a higher temperature resistance can be guaranteed and/or the necessary strength can be achieved.

The last-mentioned aspect may especially be important because in contrast to the connecting wires made of steel that are usually used for electric heaters in the state of the art, the connecting wires, which are preferably used, are here made of relatively soft and sensitive materials, e.g., copper or pure nickel, such that it may be necessary to reinforce the strength and/or increase the temperature resistance, especially when heating in contact with an oxygen-containing atmosphere.

Furthermore, it is advantageous when the connecting wire has a cross section deviating from radial symmetry. By means of this design, an increase in cross-sectional surface and thus a lowering of heat production in an unheated area of the electric heater can be achieved in space-limited designs. Depending on the concrete design or manner of space limitation, it may be especially advantageous that the connecting wire has a cross section, whose width is greater than its height or vice versa.

An especially desirable size of the contact area between the electric heating element and connecting wire can be achieved when the length of the connecting wire, especially the length of its cavity, is at least 8 times, preferably 12 times, and most preferably 20 times as great as the circumference of the electric heating element accommodated in the cavity of the connecting wire or of the feed line to the electric heating element accommodated in the cavity of the connecting wire.

Another embodiment which is advantageous with regard to the contact surface obtained is achieved when the length of the contact surface between the electric heating element and connecting wire is at least 4 times greater than the circumference of the electric heating element accommodated in the cavity of the connecting wire or of the feed line to the electric heating element accommodated in the cavity of the connecting wire.

A length corresponding at least to 10 times the circumference, and preferably one corresponding to 20 times the circumference of the electric heating element has especially proven itself.

At least if it depends primarily on providing an unheated area, such an alternative embodiment is possible, in which at least one connecting wire is connected, especially crimped within the outer jacket with an external connection line introduced into the interior of the outer jacket. It is thus achieved that the crimped contact point is effectively protected against bending and vibrations.

By means of providing the connecting wire according to the present invention with a cavity for accommodating a section of the electric heater, such an introduction is also made possible in such cases, in which such an introduction would previously have led to a too high thermal load of the insulation layer of the connecting wire before of high development of heat in the heated and/or unheated area. Therefore, it is especially advantageous when an unheated area is present, which is traversed on the connection side by means of a section of an external connection line and when the connecting wire extends over the entire remainder of unheated area (II), starting from a connection point to the external connection line.

The present invention is described in detail below on the basis of figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 9*a* is a partial sectional view showing a sixth embodiment of the connection between electric heating element and connecting wire;

FIG. 9*b* is a cross sectional view through the connection between electric heating element and connecting wire according to line A-A of FIG. 9*a;*

FIG. 10*a* is a partial sectional view showing a seventh embodiment of the connection between electric heating element and connecting wire;

FIG. 10*b* is a first cross sectional view through the connection between electric heating element and connecting wire according to FIG. 10*a* along line C-C;

FIG. 10*c* is a second cross sectional view through the connection between electric heating element and connecting wire according to FIG. 10*a* along line B-B;

FIG. 11*a* is a partial sectional view showing an eighth embodiment of the connection between electric heating element and connecting wire;

FIG. 11*b* is a cross sectional view through the connection between electric heating element and connecting wire according to line D-D of FIG. 11*a;*

FIG. 12*a* is a partial sectional view showing a ninth embodiment of the connection between electric heating element and connecting wire;

FIG. 12*b* is a cross sectional view through the connection between electric heating element and connecting wire according to line E-E of FIG. 12*a;*

DESCRIPTION OF THE PREFERRED EMBODIMENTS

Figure 1:
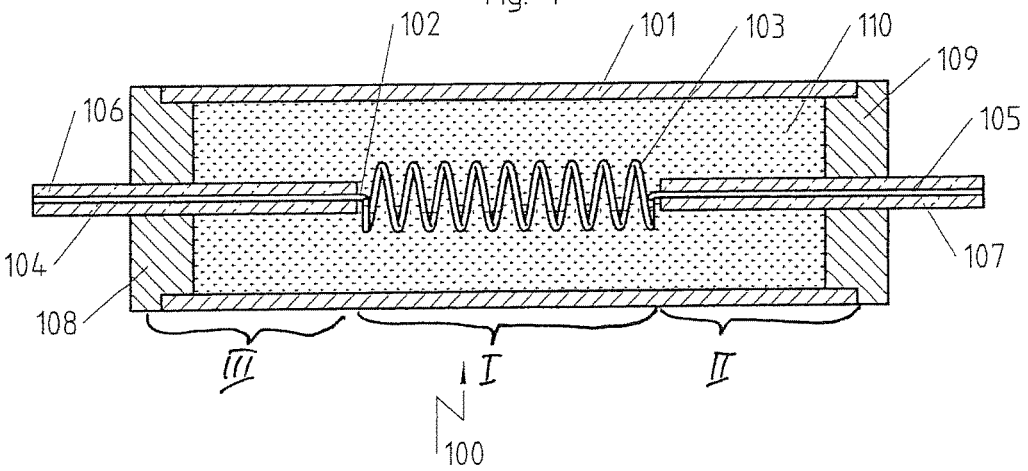
FIG. 1 is a sectional view of a first embodiment of an electric heater according to the present invention.

Referring to the drawings in particular, FIG. 1 shows a sectional view of a first embodiment of an electric heater 100 according to the present invention. The electric heater 100 has an outer jacket 101 in the form of a metal tube, within which an electric heating element 102 in the form of a resistance wire is arranged. In its middle section, the electric heater 100 has a heated area I, since there the electric heating element 102 is arranged in a number of coils 103, such that the total length of the section of the electric heating element 102, which lies in the heated area I, is greater than the length of the area I in the direction of extension of the metal tube.

On both sides of the section of the electric heating element 102 arranged in coils 103, this section has sections 104, 105, which are led as directly as possible through the interior of the electric heater 100 surrounded by the outer jacket 101. The corresponding areas II, III of the electric heater 100 are therefore unheated. The sections 104, 105 of the electric heating element 102 are accommodated in (of course, electrically conductive) connecting wires 106, 107, which have a tubular design and thus have each a cavity traversing along its direction of extension, which cavity is filled by means of the corresponding introduced sections 104, 105 of the electric heating element 102.

Two essential effects are achieved by this measure: On the one hand, the total cross section of the available conductor is increased in unheated areas II, III and thus the resistance is reduced, so that less heat output decreases in these areas, which leads to the thus designed electric heater 100 having unheated areas, which come closer to the ideal of an unheated area.

On the other hand, an extensive contact surface between the electric heating element 102 and the connecting wire 106, 107 is provided, which, for its part, is easier and safer to contact because of its larger dimensions than the electric heating element 102 proper. This applies especially to electric heaters crimped on all sides, because the formation of homogeneous surfaces is promoted by means of the crimping on all sides, which make possible an often reproducible contacting as is the case, for example, during crimping.

Both effects can be especially greatly shown to their best advantage when the connecting wire 106, 107 consists of an especially well conductive material, e.g., copper or pure nickel.

A stop plate 108 is arranged at each end of the outer jacket 101 and the interior of the electric heater defined by the outer jacket 101 and the stop plates 108, 109 is filled with an insulating material 110—as mentioned above, usually compressed—for example, magnesium oxide, provided that it is not already occupied by the electric heating element 102 and connecting wires 106, 107.

Figure 2:
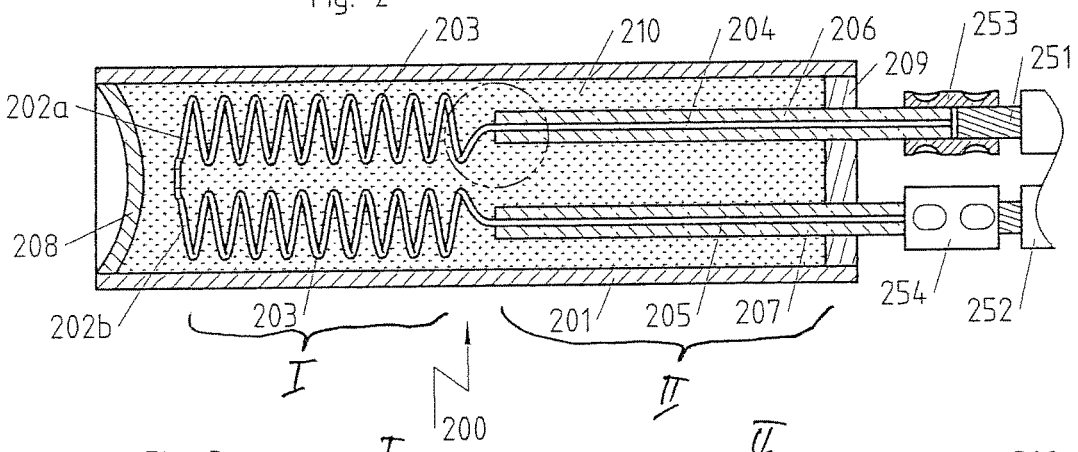
FIG. 2 is a sectional view of a second embodiment of an electric heater according to the present invention.

The second embodiment of an electric heater 200 according to the present invention shown in FIG. 2 with outer jacket 201, connecting wires 206, 207, each with a cavity in the form of a hole traversing the connecting wires along their extension, electric heating element 202 with coils 203 and sections of electric heating element 204, 205 accommodated in the cavities of the connecting wires 206, 207, as well as stop plates 208, 209, which heater is filled with an insulating material 210, differs from the embodiment according to FIG. 1 by both connections of the electric heater 202 being arranged here on the same side. Accordingly, the electric heater has an electric heating element 202 with a forward branch 202*a* and a return branch 202*b*, which merge at the end of the electric heater 200 opposite the connections. As a result of this design, the electric heater 200 has a heated area I, in which the electric heating element 202 has coils 203, and an unheated area II.

It should especially be pointed out that FIG. 2 additionally shows the connection of the connecting wires 206, 207 belonging to the electric heater 200 to the connection lines 251, 252, via which the electric heater 200 is supplied with current, which in the view according to FIG. 2 takes place by means of crimping using crimped sleeves 253, 254. It can especially be inferred from this view, on the one hand, that the sections 204, 205 introduced into the cavity of the connecting wires 206, 207 are markedly longer than is necessary for making an electric contact, and that the connecting wires 206, 207 are also markedly longer than a crimped sleeve for crimping electric lines with a diameter corresponding to the electric heating element 202.

Considering the dimensioning of the cross section of the electric heating element 202, on the one hand, and the connection lines 251, 252, on the other hand, the view according to FIG. 2 still further clearly illustrates the contact problems that occur due to the variation in cross section. By using connecting wires that have no cavity, this problem is only shifted to the interior of the electric heater, while the embodiment of the connecting wires 206, 207 according to the present invention effectively eliminates the problem by providing a large contact surface and making a close contact by means of crimping.

Figure 3:
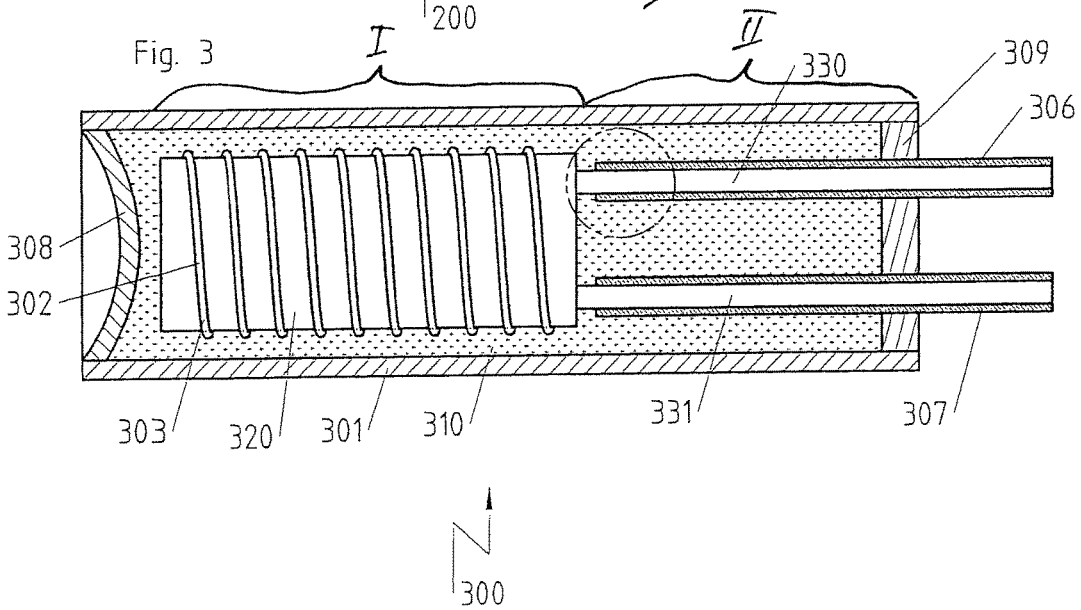
FIG. 3 is a sectional view of a third embodiment of an electric heater according to the present invention.

The third embodiment of an electric heater 300 according to the present invention with outer jacket 301, connecting wires 306, 307, each with a cavity in the form of a hole traversing the connecting wires along their extension (such that the connecting wires are tubular), electric heating element 302 with coils 303, as well as stop plates 308, 310 shown in FIG. 3 differs from the embodiment according to FIG. 2 by the electric heating element 302 in coils 303 here being wound on a coil body 320, which, for example, can be made of ceramic. This coil body defines the extension of the heated area I, while the connecting wires 306, 307 essentially extend over the entire unheated area II.

Another difference between the views according to FIG. 2 and according to FIG. 3 is that not directly the electric heating element 302, but rather electric feed lines 330, 331 are introduced into the cavity of the connecting wires 306, 307, which in turn have a tubular design. Thus, the effect basically achieved in each case that the heat output nevertheless decreasing in the unheated area is reduced by the corresponding increase in cross section is especially strongly also taken into account in the other explained embodiments. The reduction of the heat output is especially efficient if the connecting wire consists of a very readily electrically conductive material, e.g., copper.

FIGS. 4*a* through 19 show different possibilities of designing a connecting wire with a cavity and the electric heating element accommodated in this cavity and to increase the clarity of the view are limited to the features particularly essential to this partial aspect of an electric heater. These different possibilities are especially directly applicable to any of the embodiments of the electric heater described above and below.

Figures 4A, 4B, 5A, 5B, 6A, 6B, 7A, 7B, 8A, 8B:
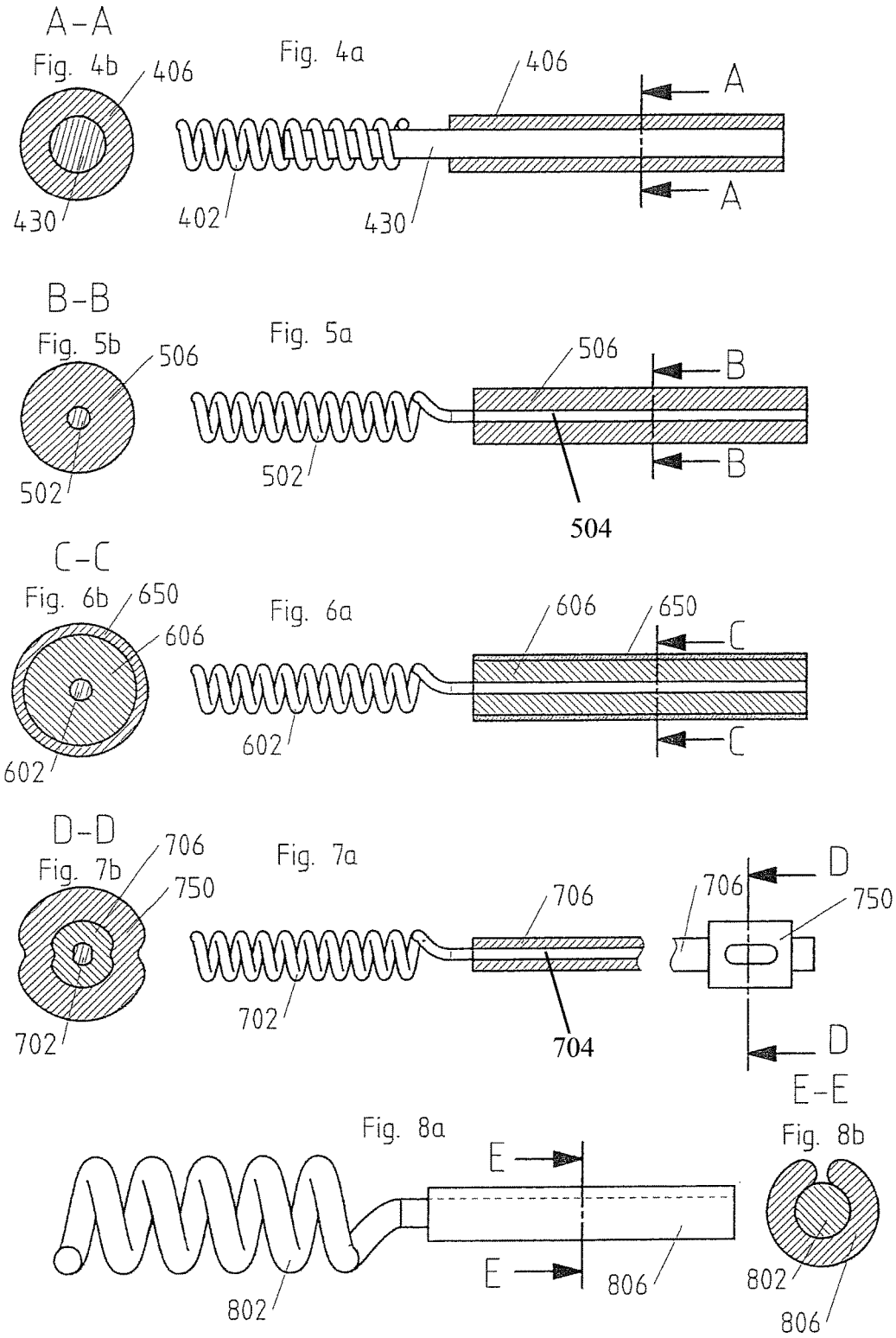
FIG. 4*a* is a partial sectional view showing a first embodiment of the connection between electric heating element and connecting wire.
FIG. 4*b* is a cross sectional view through the connection between electric heating element and connecting wire according to line A-A of FIG. 4*a;*
FIG. 5*a* is a partial sectional view showing a second embodiment of the connection between electric heating element and connecting wire.
FIG. 5*b* is a cross sectional view through the connection between electric heating element and connecting wire according to line B-B of FIG. 5*a;*
FIG. 6*a* is a partial sectional view showing a third embodiment of the connection between electric heating element and connecting wire.
FIG. 6*b* is a cross sectional view through the connection between electric heating element and connecting wire according to line C-C of FIG. 6*a;*
FIG. 7*a* is a partial sectional view showing a fourth embodiment of the connection between electric heating element and connecting wire.
FIG. 7*b* is a cross sectional view through the connection between electric heating element and connecting wire according to line D-D of FIG. 7*a;*
FIG. 8*a* is a partial sectional view showing a fifth embodiment of the connection between electric heating element and connecting wire.
FIG. 8*b* is a cross sectional view through the connection between electric heating element and connecting wire according to line E-E of FIG. 8*a;*
Figure 13B:
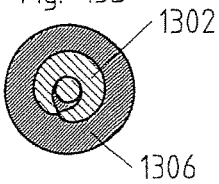
FIG. 13*b* is a cross sectional view through the connection between electric heating element and connecting wire according to line G-G of FIG. 13*a;*
Figure 13A:
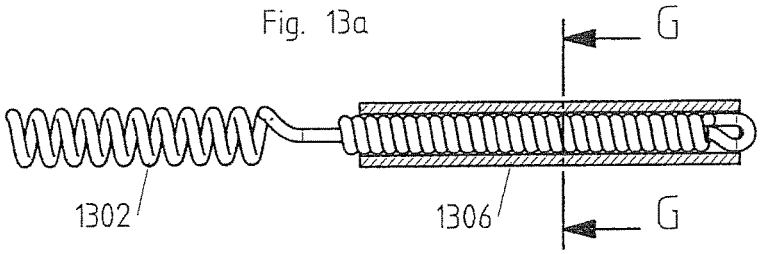
FIG. 13*a* is a tenth embodiment of the connection between electric heating element and connecting wire.
Figure 14B:
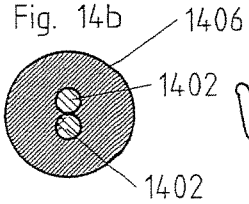
FIG. 14*b* is a cross sectional view through the connection between electric heating element and connecting wire according to line H-H of FIG. 14*a;*
Figure 14A:
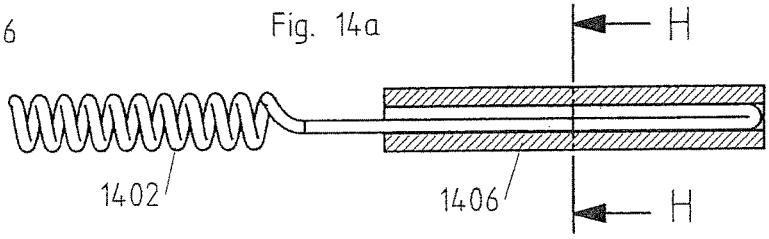
FIG. 14*a* is a partial sectional view showing an eleventh embodiment of the connection between electric heating element and connecting wire.

In the embodiment according to FIGS. 4*a* and 4*b*, the electric contact between the electric heating element 402 and connecting wire 406 is made via an electric feed line 430. The electric feed line 430 is accommodated with its one end in the cavity of the connecting wire 406 and introduced with its other end into a coiled section of the electric heating element 402. By radially compressing an electric heater that has such an arrangement, a good, all-around contact is thus brought about on both sides.

In the embodiment according to FIGS. 5*a* and 5*b* the section 504 of the electric heating element 502 is accommodated in the electrically conductive connecting wire 506, which has a tubular design and thus has traversing it along its direction of extension, i.e., in the respective routing direction of the connecting wire 506 a cavity that is filled by the corresponding introduced section 504 of the electric heating element 502. This design of the connection is characterized by particular simplicity.

The embodiment according to FIGS. 6*a* and 6*b* differs from the embodiment according to FIGS. 5*a* and 5*b* by the connecting wire 606 being surrounded by a conductive sleeve 650. For example, the possibility of achieving a welded contact can be improved by this measure with a corresponding material selection for the material of the sleeve 650. The use of a nickel sleeve is especially suitable.

The embodiment according to FIGS. 7*a* and 7*b* differs from the embodiment according to FIGS. 5*a* and 5*b* by the connecting wire 706 in the area outside of the (not shown) jacket of the electric heater being surrounded by a crimped sleeve 750. The crimped sleeve guarantees that even in an area of the connecting wire 706, in which this wire is not compressed, a good electric contact between the connecting wire 706 and section 704 of the electric heating element 702 accommodated therein can be guaranteed, as is especially readily inferred from the view according to FIG. 7*b*.

The embodiment according to FIGS. 8*a* and 8*b* differs from the embodiment according to FIGS. 5*a* and 5*b* by the type of connecting wire 806. As can especially be inferred from FIG. 8*b*, a connecting wire 806 with cavity can also be simply formed by a metal plate being bent so far around the electric heating element 802 that it forms a cavity, which is suitable for accommodating the electric heating element 802. Thus, a tube is therefore formed with a slot traversing the tube in the direction of extension.

The connecting wire 806 produced by bending advantageously covers the electric heating element 802 over an angle range >180°. This connection design is especially offered for very small designs, in which the drilling of a cavity in the connecting wire is not practical or at least very expensive.

The embodiment according to FIGS. 9*a* and 9*b* differs from the embodiment according to FIGS. 5*a* and 5*b* by the section of the electric heating element 902 only filling a part of the cavity of the connecting wire 906, while the second part is filled by another wire 950, with which a safely contacted connection is made in this way.

The embodiment according to FIGS. 10*a* and 10*b* is a variant of the embodiment according to FIGS. 6*a* and 6*b*, from which it differs by the conductive sleeve 1050, which surrounds the connecting wire 1006 and the section of the electric heating element 1002 accommodated therein, being designed as longer than the connecting wire 1006. This makes it possible for the sleeve 1050 to be used for accommodating a conductor 1060 of the (not shown) connection line and thus makes possible a reproducible and robust electric connection to same.

The embodiment according to FIGS. 11*a* and 11*b* is a variant of the embodiment according to FIGS. 8*a* and 8*b*, from which it differs by the connecting wire 1106 being surrounded by a conductive sleeve 1150, as in the embodiment according to FIG. 6.

The embodiment according to FIGS. 12*a* and 12*b* differs from the embodiment according to FIGS. 5*a* and 5*b* by the electric heating element 1202 being fastened to an electric feed line 1230 with a welded connection 1250, which is then accommodated in the cavity of the connecting wire 1206 and crimped.

As is inferred from FIGS. 13*a*, 13*b*, 14*a* and 14*b*, it is also possible to accommodate the section of the electric heating element 1302, 1402 as a coil or folded over one another in the cavity of the connecting wire 1306, 1406. This is especially of interest if the cavities cannot be designed so as to be adapted to the size.

Figure 15B:
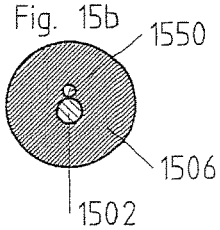
FIG. 15*b* is a cross sectional view through the connection between electric heating element and connecting wire according to line J-J of FIG. 15*a;*
Figure 15A:
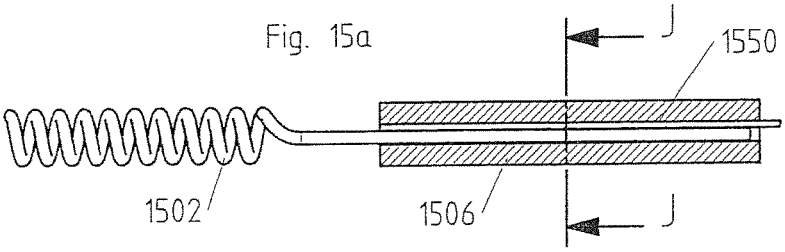
FIG. 15*a* is a partial sectional view showing a twelfth embodiment of the connection between electric heating element and connecting wire.

The embodiment that is shown in FIGS. 15*a* and 15*b* is characterized by an alternative electric contacting, which takes place by means of an auxiliary wire 1550, which is inserted together with the end section of the electric heating element 1502 into the cavity of the connecting wire 1506 and is crimped.

As can be especially easily seen in FIGS. 16*a* through 16*d*, the available conductor cross-sectional surface can be maximized by providing connecting wires 1606, 1607, 1608 having a cross section optimized with respect to the respective geometry of the electric heater 1600 and, hence, especially when the connecting wires 1606, 1607, 1608 extend over a completely unheated area, the resistance in this area and thus the heat output released there are minimized. The electric heater 1600 includes an outer jacket 1601 and at least one electric heating element 1602. An interior of the electric heater 1600 is filled with insulating material 1610. It may be especially practical when the connecting wires have a greater height than width (cf. FIG. 16*c*) or vice versa (cf. FIG. 16*d*).

Figure 16B:
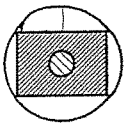
FIG. 16*b* is a cross sectional view through the connection between electric heating element and connecting wire according to line K-K of FIG. 16*a;*
Figure 16A:
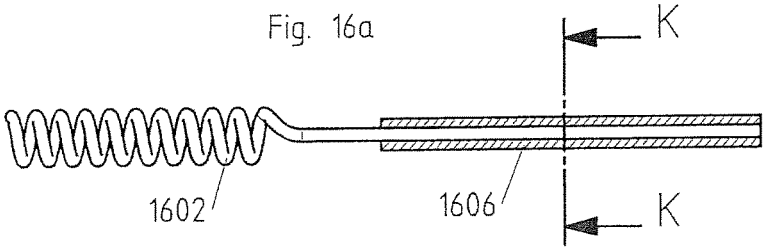
FIG. 16*a* is a partial sectional view showing a thirteenth embodiment of the connection between electric heating element and connecting wire.
Figure 16C:
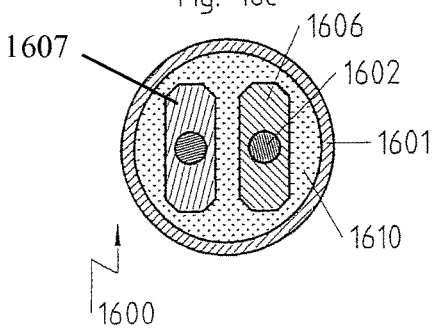
FIG. 16*c* is a cross sectional view through the connection between electric heating element and connecting wire according to FIG. 16*a* for a first, cylindrical electric heater with connections arranged on both sides.
Figure 16D:
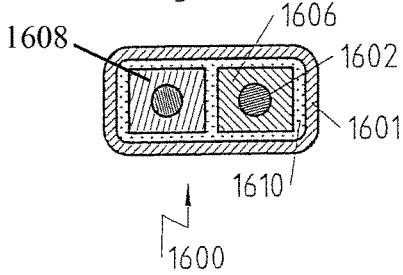
FIG. 16*d* is a cross sectional view through the connection between electric heating element and connecting wire according to FIG. 16*a* for a second electric heater with connections arranged on one side.
Figure 17:
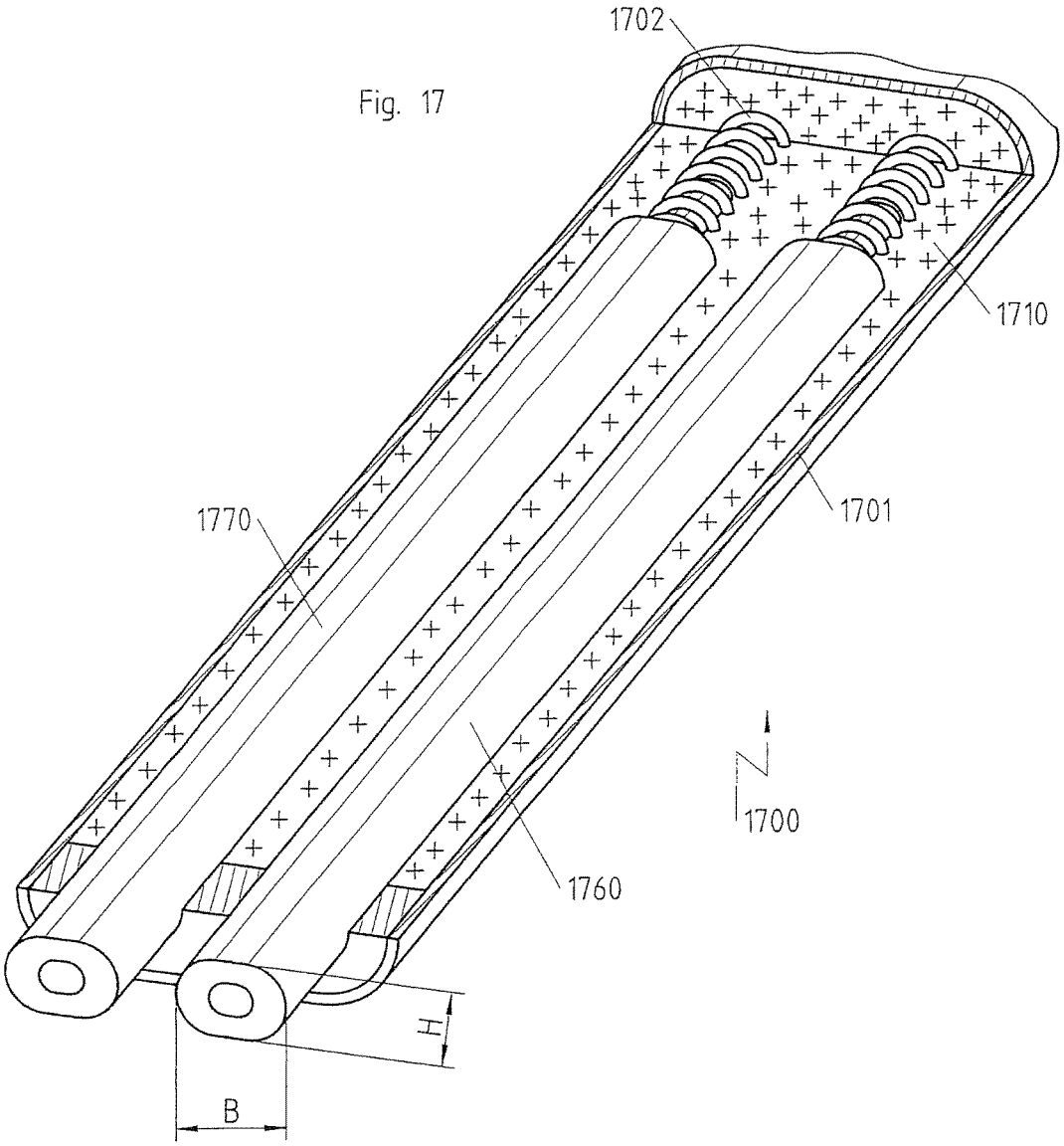
FIG. 17 is a partial sectional view of a part of an electric heater according to the present invention.

This can also be seen again in FIG. 17, which shows a partly cut-open electric heater 1700, in which the connection arrangements 1760, 1770, which are designed essentially analogously to the design shown in FIG. 16*d*, are arranged within the jacket 1701 in insulating material 1710.

In FIGS. 17, 18*a*, 18*b* and 19, it can be seen particularly well how small the design made possible by the method of connection according to the present invention is. In FIG. 17, the height of the non-cylindrically symmetrical connection arrangements 1760 and 1770 essentially corresponds to the diameter of the coils of the electric heating element 1702; in FIGS. 18*a*, 18*b* and 19 this is the case not only with respect to height, but applies to all directions lying at right angles to the direction of extension.

Figure 18A:
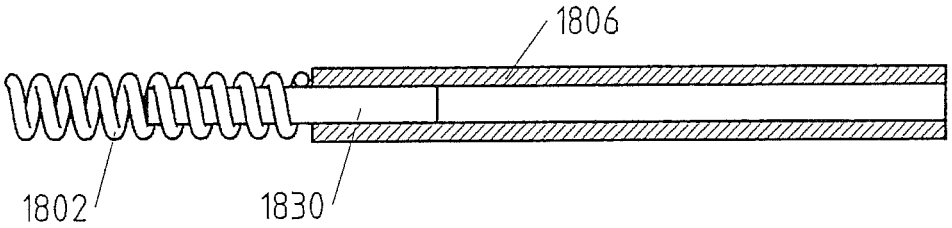
FIG. 18*a* is a partial sectional view showing a fourteenth embodiment of the connection between electric heating element and connecting wire before a crimping step.
Figure 18B:
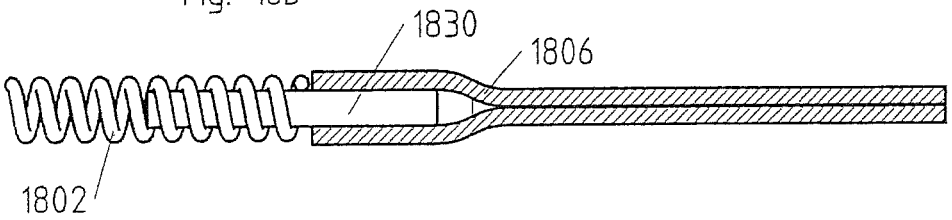
FIG. 18*b* is a partial sectional view showing the embodiment of the connection from FIG. 18*a* after crimping.

As can be seen in FIGS. 18*a* and 18*b* which show a variation of the design according to FIGS. 4*a* and 4*b* before and after a crimping step, the design which can be achieved by the arrangement according to the present invention is very small. The difference to the view according to FIGS. 4*a* and 4*b* is that the electric feed line 1830 does not fill the entire cavity of the connecting wire 1806 designed as a tube. This area is then compressed in the subsequent crimping step, such that the inner wall surfaces of the tube are adjacent to each other at least in some sections, and consequently, the outer diameter of the tube is reduced in this area. The electric feed line 1830 is connected to an electric heating element 1802.

When a section of the tube on the connection side (not shown) lies outside the crimped area, this will essentially retain the shape from FIG. 18*a*, such that a cavity on the connection side (not shown) is formed, which can advantageously be used for connecting with the conductor of a (not shown) connection line.

Figure 19:
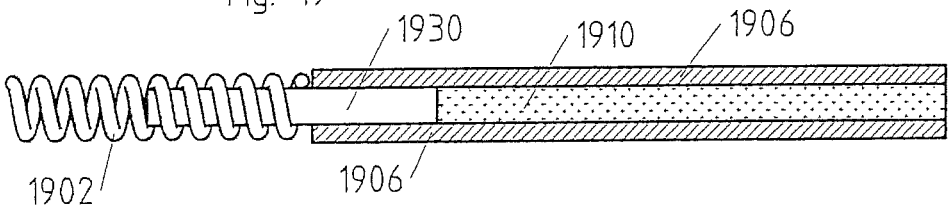
FIG. 19 is a fifteenth embodiment of the connection between electric heating element and connecting wire.

As an alternative, as shown in FIG. 19, the arrangement according to FIGS. 18*a* and 18*b* can be varied by the interior being filled with insulating material 1910.

Figure 20:
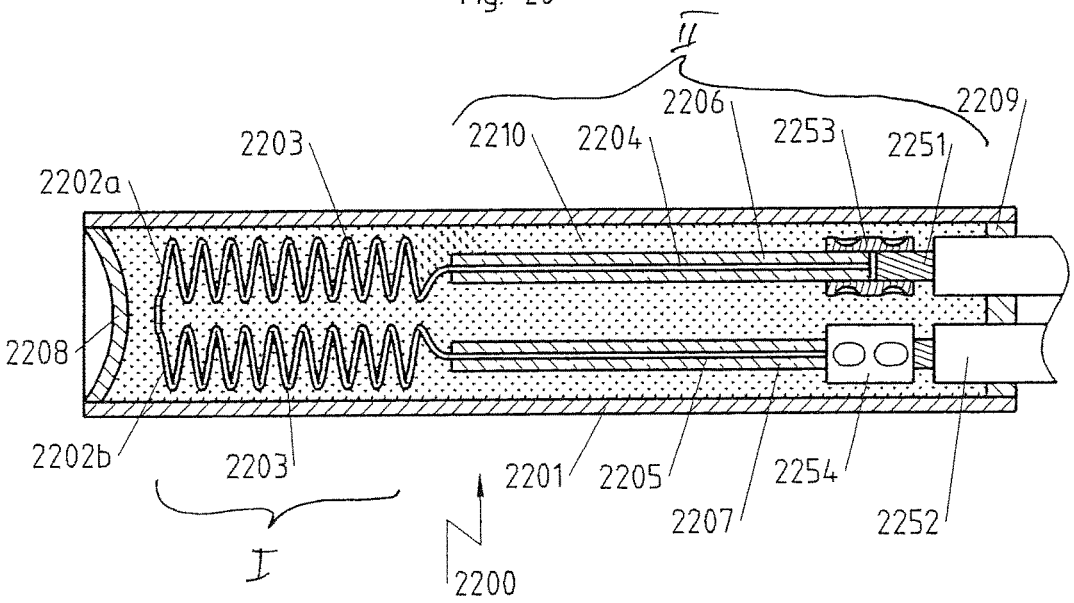
FIG. 20 is a sectional view of a fourth embodiment of an electric heater according to the present invention.

FIG. 20 shows a fourth exemplary embodiment of an electric heater 2200 according to the present invention. The difference to the embodiment according to FIG. 2 is that the connection between the connecting wires 2206, 2207 designed as tubes and external connection lines 2251, 2252 takes place here within the jacket 2201 via the crimp connectors 2253, 2254, which protects the crimped connection against mechanical stress, especially due to bending or vibrations. To be able to shift the external connection line into the interior of the electric heater defined by the outer jacket, it must be guaranteed that the insulation of the connection line can withstand the thermal load at this point of the electric heater. Providing the connecting wire with a cavity according to the present invention contributes decisively to this, because, as a result, as was already explained above, the release of heat in the unheated area can be markedly reduced. The electric heater 2200 includes an electric heating element with coils 2203 and sections 2204, 2205 of the electric heating element are accommodated in the cavities of the connecting wires 2206, 2207. The electric heater has a forward branch 2202*a* and a return branch 2202*b*, which merge at the end of the electric heater opposite the connecting wires 2206, 2207. The electric heater includes stop plates 2208, 2209. The electric heater 2200 is filled with insulating material 2210.

While specific embodiments of the invention have been shown and described in detail to illustrate the application of the principles of the invention, it will be understood that the invention may be embodied otherwise without departing from such principles.

APPENDIX

List of Reference Numbers

100, 200, 300, 1600, 1700, 2200 Electric heater
101, 201, 301, 1601, 1701, 2201 Jacket
102, 202, 302, 402, 502, 602, 702, 802, 902, 1002, 1102, 1202, 1302, 1402, 1502, 1602, 1702, 1802, 1902, 2202 Electric heating element
202*a*, 2202*a* Forward branch
202*b*, 2202*b* Return branch
103, 203, 303, 403, 503, 603, 703, 803, 903, 1003, 1103, 1203, 1303, 1403, 1503, 1603, 1703, 1803, 1903, 2203 Coil
104, 105, 204, 205, 304, 305, 2204, 2205 Sections
106, 107, 206, 207, 306, 307, 406, 506, 606, 706, 806, 906, 1006, 1106, 1206, 1306, 1406, 1506, 1606, 1607, 1608, 1706, 1806, 1906, 2206, 2207 Connecting wire
108, 109, 208, 209, 308, 309, 1708, 2208, 2209 Stop plate
110, 210, 310, 1610, 1710, 1911, 2011 Insulating material
251, 252, 2251, 2252 Connection lines
253, 254, 2253, 2254 Crimped sleeves

320 Coil body
330, 331, 430, 1230, 1830 Electric feed line
650, 1050, 1150 Conductive sleeve
750 Crimped sleeve
950 Wire
1060 Conductor
1250 Welded connection
1550 Auxiliary wire
1760, 1770 Connection arrangement
I Heated area
II, III Unheated area

What is claimed is:

1. An electric heater comprising:
an outer jacket; and
an electric heating element;
a connecting wire arranged at least in some sections within the outer jacket, the electric heating element being supplied with electric current by the connecting wire, the connecting wire having a cavity, in which a section of the electric heating element or an electric feed line to the electric heating element is accommodated, wherein the connecting wire has a cross section deviating from redial symmetry;
wherein the connecting wire is crimped with the electric heating element or the electric feed line to the electric heating element, wherein a shape of a cross section of the electric heating element is different from a shape of the cross section of the connecting wire.

2. The electric heater in accordance with claim 1, wherein the connecting wire is led through an interior enclosed by the outer jacket, said connecting wire having a connecting wire width and a connecting wire height, said connecting wire height being greater than said connecting wire width.

3. The electric heater in accordance with claim 1, wherein the connecting wire has a form of a tube with a tube wall or a form of a tube with a tube wall with a slot traversing the tube in its direction of extension, said connecting wire having a connecting wire width and a connecting wire height, said connecting wire width being greater than said connecting wire height.

4. The electric heater in accordance with claim 3, wherein the cross-sectional surface of the tube wall is greater than the cross section of the electric heating element, said connecting wire comprising a non-cylindrically symmetrical shape.

5. The electric heater in accordance with claim 3, wherein the wall thickness of the tube is smaller than a diameter of the electric heating element.

6. The electric heater in accordance with claim 3, wherein the tube has a section that is not filled by the electric heating element or by the electric feed line to the electric heating element, and the section is at least partly crimped, such that the outer diameter of the tube is reduced in the section.

7. The electric heater in accordance with claim 1, wherein the cavity is arranged in a compressed section of the electric heater.

8. The electric heater in accordance with claim 1, wherein the connecting wire extends further into an interior of the electric heater surrounded by the outer jacket as is necessary for creating an electric connection.

9. The electric heater in accordance with claim 1, wherein an unheated area is provided at least one end of an area of the electric heater enclosed by the outer jacket, and the connecting wire extends over the entire unheated area.

10. The electric heater in accordance with claim 1, wherein the connecting wire is formed of a material which has a higher electric conductivity than an electric conductivity of the electric heating element.

11. The electric heater in accordance with claim 1, wherein the connecting wire is surrounded by a sleeve or a slotted sleeve at least in some sections.

12. The electric heater in accordance with claim 11, wherein a material of the sleeve is has at least one of:
a greater weldability than a material of the connecting wire;
a higher temperature resistance than the material of the connecting wire; and
a higher strength than the material of the connecting wire.

13. The electric heater in accordance with claim 1, wherein the connecting wire has a cross section with a width that is greater than a height or vice versa.

14. The electric heater in accordance with claim 1, wherein a length of the connecting wire is at least eight times as great as a circumference of the electric heating element or a circumference of the electric feed line to the electric heating element.

15. The electric heater in accordance with claim 1, wherein the length of a contact surface between an electric heating element and a connecting wire is greater than four times a circumference of the electric heating element or the electric feed line to the electric heating element.

16. The electric heater in accordance with claim 1, further comprising an external connection line wherein at least one connecting wire is connected or crimped within the outer jacket with the external connection line introduced into an interior of the outer jacket.

17. The electric heater in accordance with claim 16, wherein an unheated area is present, which is traversed, on a connection side, by a section of an external connection line, and the connecting wire extends over an entire remainder of the unheated area starting from a connection point to the external connection line.

18. The electric heater comprising:
an outer jacket; and
an electric heating element;
a connecting wire arranged at least in some sections within the outer jacket, the electric heating element being supplied with electric current by the connecting wire, the connecting wire having a cavity, in which a section of the electric heating element or an electric feed line to the electric heating element is accommodated, said connecting wire comprising a cross section having a connecting wire cross section height and a connecting wire cross section width, wherein one of said connecting wire cross section height is greater than said connecting wire cross section width and said connecting wire cross section width is greater than said connecting wire cross section height;
and another connecting wire comprising another connecting wire non-radially symmetric cross section, said electric heating element comprising an electric heating element cross section, said connecting wire comprising a non-radially symmetric cross section, wherein a shape of said non-radially symmetric cross section is different from a shape of said electric heating element cross section, wherein a shape of said another connecting wire non-radially symmetric cross section is different from said shape of said electric heating element cross section, said electric heating element comprising a first coil and a second coil, said first coil being located at a radially spaced location from said second coil with respect to a longitudinal axis of said outer jacket, said another connecting wire being located at a radially spaced from said connecting wire with respect to said longitudinal axis.

* * * * *